US010465969B2

(12) United States Patent
Lv et al.

(10) Patent No.: US 10,465,969 B2
(45) Date of Patent: Nov. 5, 2019

(54) REFRIGERATOR

(71) Applicant: BSH HAUSGERAETE GMBH, Munich (DE)

(72) Inventors: Ping Lv, Nanjing (CN); Yaoguo Xu, Nanjing (CN); Chuan Zhang, Chuzhou (CN)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/836,960

(22) Filed: Dec. 11, 2017

(65) Prior Publication Data

US 2018/0187952 A1 Jul. 5, 2018

(30) Foreign Application Priority Data

Dec. 29, 2016 (CN) ..... 2016 1 1254117

(51) Int. Cl.
*F25D 23/02* (2006.01)
*E05D 11/00* (2006.01)

(52) U.S. Cl.
CPC ..... *F25D 23/028* (2013.01); *E05D 11/0054* (2013.01); *E05D 11/0081* (2013.01); *F25D 23/025* (2013.01); *E05Y 2900/31* (2013.01); *F25D 2323/023* (2013.01); *F25D 2323/024* (2013.01)

(58) Field of Classification Search
CPC ..... F25D 23/025; F25D 23/028; F25D 2323/023; F25D 2323/024; F25D 2400/40; F25D 23/02; F25D 23/04; E05Y 2900/31; E05D 11/0054; E05D 11/0081; E05D 3/06; E05D 3/08; E05D 3/12; E05D 3/122; E05D 3/125; E05D 3/127; A47K 13/12
USPC .... 16/365, 366, 368, 369; 49/397, 398, 400, 49/401
See application file for complete search history.

(56) References Cited

U.S. PATENT DOCUMENTS

2006/0064846 A1* 3/2006 Espindola ..... E05D 11/0081 16/223
2012/0096872 A1 4/2012 Cheong et al.
2012/0286639 A1* 11/2012 Lee ..... F25D 23/025 312/405.1
2014/0132144 A1* 5/2014 Kim ..... F25D 23/028 312/405

(Continued)

FOREIGN PATENT DOCUMENTS

EP 2444761 A2 4/2012
EP 2730867 A2 5/2014

(Continued)

*Primary Examiner* — Hiwot E Tefera
(74) *Attorney, Agent, or Firm* — Laurence A. Greenberg; Werner H. Stemer; Ralph E. Locher

(57) ABSTRACT

A refrigerator includes a case body; a first door, pivotally connected to the case body by using a first hinge; and a second door, pivotally connected to the first door by using a second hinge. The top of the first door is provided with a first installation portion adapted to install the first hinge and a second installation portion adapted to install the second hinge. The second installation portion includes a groove recessed downwards from the first installation portion. The solution of the present invention can reserve more space for movement of a door body along a height direction, thereby avoiding interference between the first hinge and the second hinge.

18 Claims, 4 Drawing Sheets

(56) References Cited

U.S. PATENT DOCUMENTS

| | | | | |
|---|---|---|---|---|
| 2014/0139091 | A1* | 5/2014 | Oh | F25D 23/02 312/404 |
| 2014/0232251 | A1* | 8/2014 | Kim | F25D 23/028 312/404 |
| 2015/0233629 | A1* | 8/2015 | Choi | F25D 23/04 312/404 |
| 2016/0061511 | A1* | 3/2016 | Park | F25D 11/02 312/404 |
| 2016/0123055 | A1* | 5/2016 | Ueyama | F25D 23/028 312/405 |
| 2017/0188721 | A1* | 7/2017 | Park | F21V 29/89 |
| 2017/0211874 | A1* | 7/2017 | Kim | F25D 23/025 |
| 2017/0321959 | A1* | 11/2017 | Kim | G01D 5/02 |
| 2017/0370634 | A1* | 12/2017 | Kim | F25D 27/00 |

FOREIGN PATENT DOCUMENTS

| | | | | |
|---|---|---|---|---|
| EP | 2770283 | A2 | 8/2014 | |
| WO | 2004048865 | A1 | 6/2004 | |
| WO | WO-2016060530 | A1 * | 4/2016 | F25D 23/00 |

* cited by examiner

REFRIGERATOR

CROSS-REFERENCE TO RELATED APPLICATION

This application claims the benefit, under 35 U.S.C. § 119, of Chinese patent application CN 201611254117.8, filed Dec. 29, 2016; the prior application is herewith incorporated by reference in its entirety.

BACKGROUND

Technical Field

The present invention relates to a refrigerator.

Related Art

A storage space of a refrigerator is closed by using a single-layer door, or may be closed by using a double-layer door including an inner door and an outer door. A double-layer door includes an inner door connected to a case body and an outer door connected to the inner door. The outer door is connected to the inner door by using a hinge and the inner door is connected to the case body by using a hinge. An existing hinge installation structure between the inner door and the outer door easily interferes with a hinge installation structure between the inner door and the case body, or components such as hinges may be easily exposed, affecting the appearance.

BRIEF SUMMARY OF THE INVENTION

The present invention provides an improved refrigerator, to resolve at least one of the foregoing technical problems.

To resolve the foregoing problems, the present invention provides a refrigerator, including: a case body; a first door, articulated (i.e., pivotally connected) to the case body by using a first hinge; and a second door, articulated (i.e., pivotally connected) to the first door by using a second hinge, where the top of the first door is provided with a first installation portion adapted to install the first hinge and a second installation portion adapted to install the second hinge, and the second installation portion includes a groove recessed downwards from the first installation portion.

Compared with the prior art, the technical solution of the present invention has the following advantage: the second installation portion is recessed downwards from the first installation portion, and the second hinge is fixed in the groove of the second installation portion, to reserve a sufficient height difference between the second hinge and the first hinge. The height difference is greater than a height difference between a first hinge and a second hinge in the prior art. When the first door and the second door, taken as a whole, need to be adjusted and moved upwards along a height direction, the second hinge may move upwards with the first door and the second door within a range of the foregoing height difference, so that a location adjustment space of a door body along the height direction is enlarged, avoiding interference between the first hinge and the second hinge.

Optionally, the first door includes a longitudinal side surface close to the first installation portion, and the first installation portion is located between the longitudinal side surface and the groove.

Optionally, the second door has a third installation portion adapted to be connected to a second end, and the third installation portion is higher than the second installation portion. Relative locations of the third installation portion and the first installation portion along the height direction of the door may be set according to the shape of the first hinge. In some embodiments, the first hinge is planar, and the third installation portion and the first installation portion are flush with each other.

Optionally, the second hinge includes: a first end connected to the first door, a second end connected to the second door, and a hinge shaft that extends downwards from the second end; and the first end is disposed in the groove and is lower than the second end. The second hinge is provided, on the first end, with a first part that is accommodated and fixed in the groove and a second part that extends out of the groove, where the second part is located in front of the first door, and the second part is provided with a hinge shaft or a shaft hole.

Preferably, the shape and the size of the first part are basically consistent with the shape and the size of a bottom wall of the groove. In this way, on one hand, the first part may be prevented from shaking in the groove, and on the other hand, a gap between the second hinge and an inner wall of the groove may be reduced, thereby improving the appearance of the top of the door body.

Optionally, a hinge cover for covering the second hinge is further included, to improve the overall appearance of the door.

Optionally, the contour shape of the hinge cover on a circumferential edge matches the contour shape of the second hinge on a circumferential edge, so as to completely cover the second hinge.

In some embodiments, the second hinge and the hinge cover are clamped with each other. There may be a plurality of manners of clamping. For example, the second hinge and the hinge cover are clamped with each other by using flanges: an edge of the second hinge is provided with a first flange protruding towards the hinge cover, an edge of the hinge cover is provided with a second flange protruding towards the second hinge, and the second flange is inserted into the first flange.

Optionally, the first flange surrounds the edge of the second hinge to form an annular slot, and/or the second flange surrounds the edge of the hinge cover to form an annular slot, where the shape of an annular structure enclosed by the first flange is consistent with the shape of an annular structure enclosed by the second flange.

Optionally, a cable that extends from the first door into the groove, passes through the second hinge, and extends to the second door along second hinge is further included.

Optionally, the second hinge includes an accommodating cavity adapted to accommodate a cable that extends from the first door into the second door.

Optionally, a hollow positioning column is further disposed in the groove, and the second hinge further includes a positioning hole matching the hollow positioning column. The first part is sleeved outside the hollow positioning column by using the positioning hole, so as to position the second hinge.

Optionally, a cable installation hole through which a cable passes is disposed in a groove wall of the groove, and the cable installation hole and the hollow positioning column are coaxial and communicated. The cable may pass out through the cable installation hole and the hollow positioning column.

Other features which are considered as characteristic for the invention are set forth in the appended claims.

Although the invention is illustrated and described herein as embodied in a refrigeration appliance, it is nevertheless not intended to be limited to the details shown, since various modifications and structural changes may be made therein without departing from the spirit of the invention and within the scope and range of equivalents of the claims.

DETAILED DESCRIPTION

To make the foregoing objective, features, and advantages of the present invention more comprehensible, specific embodiments of the present invention are described in detail below with reference to the accompanying drawings.

Figure 1:
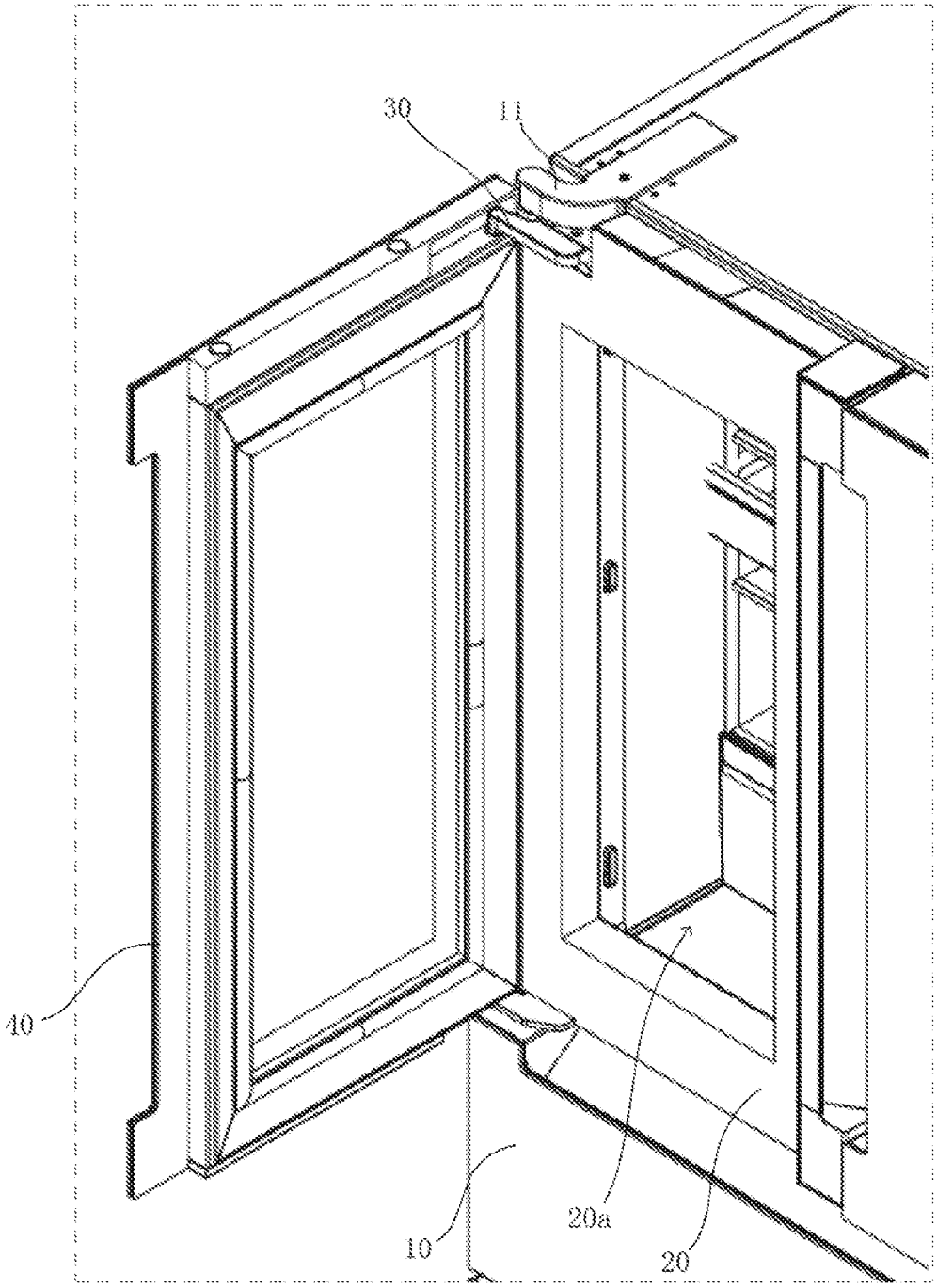
FIG. 1 is a partial schematic three-dimensional structural diagram of a refrigerator according to an embodiment of the present invention.

The embodiments of the present invention provide a refrigerator. As shown in FIG. 1, the refrigerator includes a case body 10, a first door 20 rotatably connected to the case body 10 by using a first hinge 11, and a second door 40 rotatably connected to the first door 20 by using a second hinge 30.

A storage space is disposed in the first door 20 to store objects. The storage space of the first door 20 has an opening 20*a* facing the second door 40, and the second door 40 may open or close the opening 20*a*.

Figure 2:
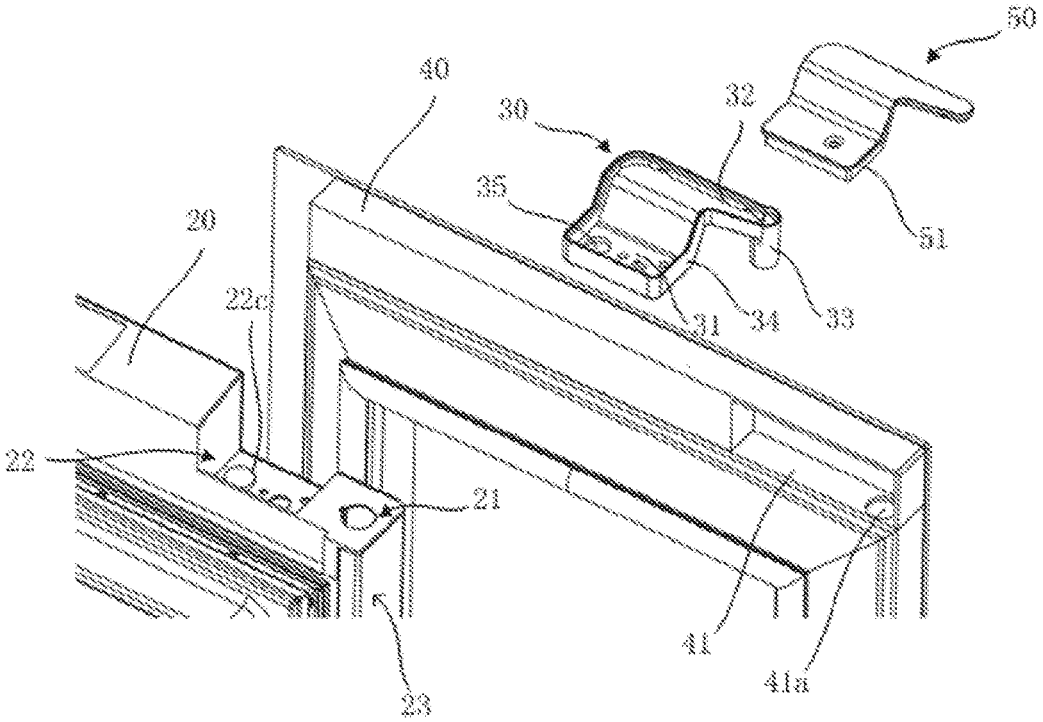
FIG. 2 and FIG. 3 respectively show partial schematic breakdown structural diagrams of a door of the refrigerator according to this embodiment of the present invention from two angles of view.
Figure 3:
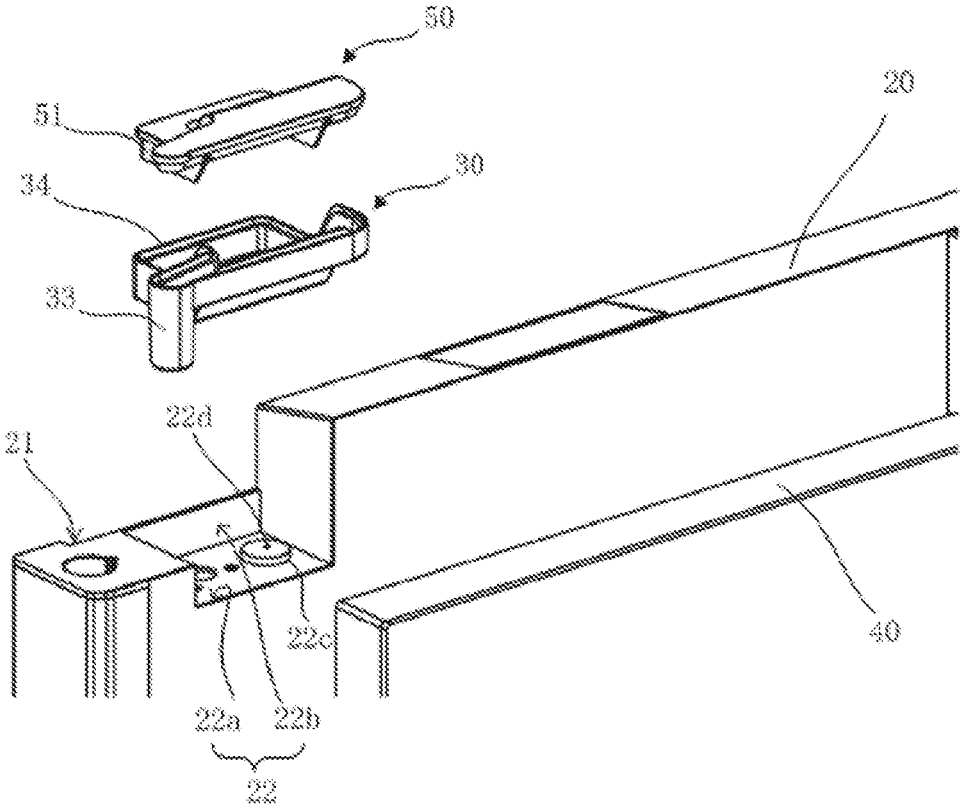

As shown in FIG. 2 in combination with FIG. 3, the top of the first door 20 is provided with a first installation portion 21 adapted to install the first hinge 11 and a second installation portion 22 adapted to install the second hinge 30. The second installation portion 22 is a groove recessed downwards from the first installation portion 21. In some other embodiments, the shape of the second installation portion 22 may be adjusted according to the shape of the second hinge. For example, the second installation portion 22 may include other components than the groove.

The groove of the second installation portion 22 has a bottom wall 22*a*, side walls (not marked in the figures) located on two sides of the bottom wall 22*a* along a width direction of the door, and an inner wall 22*b* located behind the bottom wall 22*a* along a front-rear direction of the door. The inner wall 22*b* may be used to block the second hinge 30 behind the first door 20, so that on one hand, the appearance of the first door 20 is improved, and on the other hand, an antifouling effect is achieved.

The advantage of this solution is that the second installation portion is recessed downwards from the first installation portion, and the second hinge is fixed in the groove of the second installation portion, to reserve a sufficient height difference between the second hinge and the first hinge. The height difference is greater than a height difference between a first hinge and a second hinge in the prior art. When the first door and the second door, taken as a whole, need to be adjusted and moved upwards along a height direction, the second hinge may move upwards with the first door and the second door within a range of the foregoing height difference, so that a location adjustment space of a door body along the height direction is enlarged, avoiding interference between the first hinge and the second hinge.

As shown in FIG. 2 and FIG. 3, the second door 40 has a third installation portion 41 adapted to be connected to a second end of the second hinge 30. The third installation portion 41 is higher than the second installation portion 22. Correspondingly, the second hinge 30 includes a first end connected to the first door 20, and the second end connected to the second door 40. The second end has a hinge shaft 33 (or may be a shaft hole) extending downwards. The first end is disposed in the groove of the second installation portion 22 and is lower than the second end.

The second hinge 30 is provided, on the first end, with a first part 31 that is accommodated and fixed in the groove and a second part 32 that extends out of the groove. The first part 31 is basically completely located in the groove. The second part 32 is located in front of the first door 20. The second part 32 is provided with the hinge shaft 33 (or the shaft hole). The second hinge 30 is connected to the second door 40 at the location of the hinge shaft 33 (or the shaft hole). In this embodiment, a shaft hole 41*a* is disposed in the third installation portion 41. The hinge shaft 33 is inserted into the shaft hole 41*a*.

To prevent the first part 31 from shaking in the groove, the shape and the size of the first part 31 are basically consistent with the shape and the size of the bottom wall of the groove. In this way, a gap between the second hinge 30 and the inner wall of the groove can be reduced, thereby improving the appearance of the top of the door body.

In addition, relative locations of the third installation portion 41 and the first installation portion 21 along the height direction of the door may be set according to the shape of the first hinge 11. Generally, the first hinge 11 is planar, and the third installation portion 41 and the first installation portion 21 are flush with each other.

As shown in FIG. 2, the first door 20 includes a longitudinal side surface 23 close to the first installation portion 21, and the first installation portion 21 is located between the longitudinal side surface 23 and the groove of the second installation portion 22. Therefore, a rotation axis of the first door 20 is closer to an edge of the door than a rotation axis of the second door 40.

Figure 4:
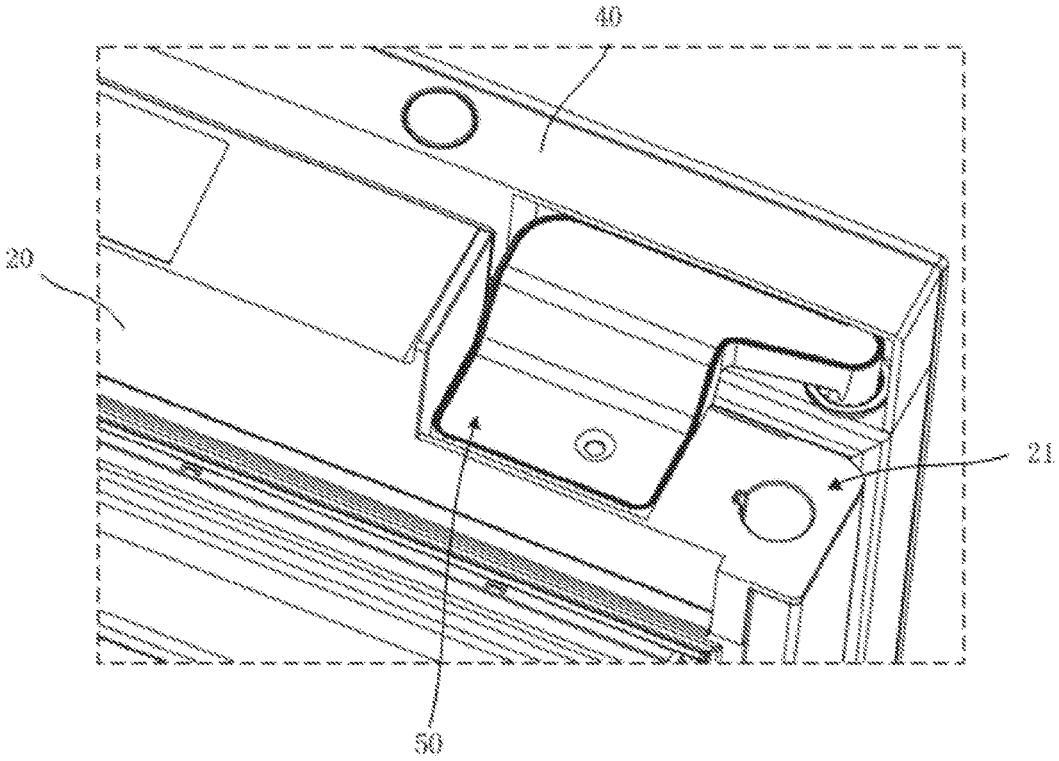
FIG. 4 shows the structures of a first installation portion, a second installation portion, and a second hinge of the refrigerator when a second door and a first door are in a superposed state according to this embodiment of the present invention.

Further, as shown in FIG. 2 and FIG. 3 in combination with FIG. 4, to improve the overall appearance of the door, the refrigerator of this embodiment further includes a hinge cover 50 for covering the second hinge 30. The contour shape of the hinge cover 50 on a circumferential edge matches the contour shape of the second hinge 30 on a circumferential edge, so as to completely cover the second hinge 30 (as shown in FIG. 4). When the hinge cover 50 is covered on the second hinge 30, corresponding to the second hinge 30, one part of the hinge cover 50 is located in the groove of the second installation portion 22, and the other part of the hinge cover 50 extends out of the groove. The contour shape of the part, located in the groove, of the hinge cover 50 is basically consistent with the contour shape of the first part of the second hinge 30, and the contour shape of the part, extending out of the groove, of the hinge cover 50 is basically consistent with the contour shape of the second part of the second hinge 30.

The hinge cover 50 is covered on the second hinge 30, and locations of the hinge cover 50 and the second hinge 30 are relatively fixed. There may be a plurality of manners of relatively fixing the hinge cover 50 to the second hinge 30, such as mutual clamping, connection by using a connection member such as a screw, and bonding. In this embodiment, the manner of mutual clamping is used, and mutual clamping is performed by clamping a clamping slot with a clamping block, or by clamping flanges. In this embodiment, clamping is performed by clamping flanges.

Specifically, an edge of the second hinge 30 is provided with a first flange 34 protruding towards the hinge cover 50 and an edge of the hinge cover 50 is provided with a second flange 51 protruding towards the second hinge 30. The second flange 51 is inserted into the first flange 34.

In this embodiment, the first flange 34 surrounds the edge of the second hinge 30 to form an annular slot, and the second flange 51 surrounds the edge of the hinge cover 50 to form an annular slot. The shape of an annular structure enclosed by the second flange 51 is consistent with the shape of an annular structure enclosed by the first flange 34, but the size of the annular structure enclosed by the second flange 51 is slightly less than the shape of the annular structure enclosed by the first flange 34. Therefore, the second flange 51 may be integrally inserted into a ring enclosed by the first flange 34. In some other embodiments, the first edge and the second edge may alternatively be set as one or more flanges located on circumferential edges of the components where the first edge and the second edge are located, and are clamped with each other.

To strengthen fixation, the bottom wall 22*a* of the groove, the first part 31 of the second hinge 30, and the hinge cover 50 may also be provided with fixing holes corresponding to each other through which a connection member such as a bolt passes, so that the bottom wall 22*a* of the groove, the first part 31 of the second hinge 30, and the hinge cover 50 are fixed together by using the connection member.

When the hinge cover 50 is covered on the second hinge 30 and is clamped with the second hinge 30 by using the first flange 34 and the second flange 51, an accommodating cavity having a particular volume is formed between the second hinge 30 and the hinge cover 50. The accommodating cavity may be used to accommodate a cable or another component that passes from the second hinge 30.

As shown in FIG. 2 and FIG. 3, a hollow positioning column 22*c* is further disposed in the groove of the second installation portion 22, and the second hinge 30 further includes a positioning hole 35 matching the hollow positioning column 22*c*. When the first part 31 of the second hinge 30 is disposed in the groove, the first part 31 is sleeved outside the hollow positioning column 22*c* by using the positioning hole 35, so as to position the second hinge 30.

A cable installation hole 22*d* through which a cable passes is disposed in the bottom wall 22*a* of the groove. The cable installation hole 22*d* and the hollow positioning column 22*c* are coaxial and communicated. The cable may pass out through the cable installation hole 22*d* and the hollow positioning column 22*c*. In some other embodiments, the cable installation hole 22*d* and the hollow positioning column 22*c* may alternatively be disposed on the side walls of the groove. The cable extends from the first door 20 into the groove through the cable installation hole 22*d*, passes into the accommodating cavity of the second hinge 30 from the hollow positioning column 22*c*, and extends into the second door 40 along the second hinge 30 through the accommodating cavity of the second hinge 30.

Although the present invention is disclosed as above, the present invention is not limited thereto. Any person skilled in the art can make various variations and modifications without departing from the spirit and scope of the present invention, and therefore the protection scope of the present invention is subject to the appended claims.

The invention claimed is:

1. A refrigerator, comprising:

a case body;

a first door articulated on said case body by way of a first hinge;

a second door articulated on said first door by way a second hinge, wherein the first door having a top side surface and a top provided with a first installation portion adapted to install the first hinge, the first installation portion being recessed below the top side surface, and a second installation portion configured to install the second hinge, the first door having a side face facing toward said second door;

said second installation portion being a groove recessed downwards from the first installation portion, said groove opening out of said side face of said first door.

2. The refrigerator according to claim 1, wherein the second hinge comprises:

a first end connected to the first door, a second end connected to the second door, and a hinge shaft that extends downwards from the second end; and the first end is disposed in the groove and is lower than the second end.

3. The refrigerator according to claim 1, wherein the first door comprises a longitudinal side surface close to the first installation portion, and the first installation portion is located between the longitudinal side surface and the groove.

4. The refrigerator according to claim 1, wherein the second door has a third installation portion adapted to be connected to a second end of the second hinge, and the third installation portion is higher than the second installation portion.

5. The refrigerator according to claim 4, wherein the third installation portion is flush with the first installation portion.

6. The refrigerator according to claim 1, wherein the second hinge has a first part that is accommodated and fixed in the groove.

7. The refrigerator according to claim 6, wherein the second hinge further comprises a second part that extends out of the groove, the second part is located in front of the first door, and the second part is provided with a hinge shaft or a shaft hole.

8. The refrigerator according to claim 1, further comprising a hinge cover for covering the second hinge.

9. The refrigerator according to claim 8, wherein a contour shape of the hinge cover on a circumferential edge matches a contour shape of the second hinge on a circumferential edge, so as to completely cover the second hinge.

10. The refrigerator according to claim 8, wherein an edge of the second hinge is provided with a first flange protruding towards the hinge cover and an edge of the hinge cover is provided with a second flange protruding towards the second hinge, wherein the second flange is inserted into the first flange.

11. The refrigerator according to claim 10, wherein the first flange surrounds the edge of the second hinge to form an annular slot, and/or the second flange surrounds the edge of the hinge cover to form an annular slot, wherein the shape of an annular structure enclosed by the first flange is consistent with the shape of an annular structure enclosed by the second flange.

12. The refrigerator according to claim 1, further comprising a cable that extends from the first door into the groove, passes through the second hinge, and extends to the second door along second hinge.

13. The refrigerator according to claim 1, wherein the second hinge comprises an accommodating cavity adapted to accommodate a cable that extends from the first door into the second door.

14. The refrigerator according to claim 1, wherein a hollow positioning column is further disposed in the groove, and the second hinge further comprises a positioning hole matching the hollow positioning column.

15. The refrigerator according to claim 14, wherein the groove is provided with a cable installation hole through which a cable passes, and the cable installation hole and the hollow positioning column are coaxial and communicated.

16. The refrigerator according to claim 1, wherein the groove has a bottom wall, side walls located on two sides of the bottom wall, the side wall are spaced apart along a width direction of the door.

17. The refrigerator according to claim 16, wherein the first door has a longitudinal side and one of the side walls and the longitudinal side delimit the first installation portion.

18. A refrigerator, comprising:

a case body;

a first door articulated on said case body by way of a first hinge;

a second door articulated on said first door by way a second hinge, wherein the first door having a top provided with a first installation portion adapted to install the first hinge and a second installation portion configured to install the second hinge, the first door having a side face facing toward said second door;

said second installation portion being a groove recessed downwards from the first installation portion, said groove opening out of said side face of said first door;

the second hinge having a first part being accommodated and fixed in the groove, a shape and a size of the first part being basically consistent with a shape and a size of a bottom wall of the groove.

* * * * *